US006874860B2

(12) United States Patent
Lahut et al.

(10) Patent No.: US 6,874,860 B2
(45) Date of Patent: Apr. 5, 2005

(54) MULTI-SPEED, MULTI-RESOLUTION PRINT HEADS

(75) Inventors: Joseph A. Lahut, Center Harbor, NH (US); Arthur L. Cleary, Center Harbor, NH (US)

(73) Assignee: Vutek, Incorporated, Meredith, NH (US)

( * ) Notice: Subject to any disclaimer, the term of this patent is extended or adjusted under 35 U.S.C. 154(b) by 0 days.

(21) Appl. No.: 10/281,292

(22) Filed: Oct. 24, 2002

(65) Prior Publication Data

US 2003/0090539 A1 May 15, 2003

Related U.S. Application Data

(60) Provisional application No. 60/336,286, filed on Oct. 25, 2001.

(51) Int. Cl.[7] ..... B41J 29/38; B41J 2/155; B41J 2/21

(52) U.S. Cl. ..... 347/13; 347/42; 347/43

(58) Field of Search ..... 347/12, 13, 40, 347/41, 42, 43

(56) References Cited

U.S. PATENT DOCUMENTS 4,593,295 A * 6/1986 Matsufuji et al. ..... 347/41
4,967,203 A 10/1990 Doan et al.
5,059,984 A 10/1991 Moore et al.
5,790,150 A 8/1998 Lidke et al.
5,992,972 A * 11/1999 Nagoshi et al. ..... 347/43
6,089,697 A * 7/2000 Tajika et al. ..... 347/43
6,241,338 B1 6/2001 Otsuki
6,273,550 B1 * 8/2001 Brown ..... 347/43

* cited by examiner

*Primary Examiner*—Michael S. Brooke
(74) *Attorney, Agent, or Firm*—Hamilton, Brook, Smith & Reynolds, P.C.

(57) ABSTRACT

A printing apparatus for printing images on a substrate includes a first set of print heads $S_1$ having at least one print head $P_{1,1}$ arranged to deposit a first ink $I_1$, and a second set of print heads $S_2$ having at least two print heads $P_{2,1}$, $P_{2,2}$ arranged to deposit a second ink $I_2$. The at least one print head $P_{1,1}$ of the first set $S_1$ and a first print head $P_{2,1}$ of the second set $S_2$ respectively depositing the first ink $I_1$ and the second ink $I_2$ in a first order of deposition $O_1$, and the at least one print head $P_{1,1}$ of the first set $I_1$ and a second print head $P_{2,2}$ of the second set $S_2$ respectively depositing the first ink $I_1$ and the second ink $I_2$ in a second order of deposition $O_2$ as the printing apparatus traverses across the substrate in one direction $D_1$. The order of deposition of the first ink $I_1$ and the second ink $I_2$ from the print heads is reversed as the printing apparatus traverses across the substrate in an opposite direction $D_2$.

15 Claims, 11 Drawing Sheets

MULTI-SPEED, MULTI-RESOLUTION PRINT HEADS

RELATED APPLICATION

This application claims the benefit of U.S. Provisional Application No. 60/336,286, filed Oct. 25, 2001, the entire teachings of which are incorporated herein by reference.

BACKGROUND

Certain types of printing systems are adapted for printing images on large-scale printing media, such as for museum displays, billboards, sails, bus boards, and banners. Some of these systems use so-called drop on demand ink jet printing. In these systems, a piezoelectric vibrator applies pressure to an ink reservoir of the printhead to force the ink out through the nozzle orifices positioned on the underside of the printheads. As a carriage which holds the set of print heads scans across the width of the print medium, the print heads deposit ink as the substrate moves. A particular image is created by controlling the order at which ink is ejected from the various nozzle orifices.

Some of these systems use inks with different colors to create the desired image. For instance, black, yellow, cyan, and magenta colored inks are commonly employed alone or in combination to generate the image. Thus combinations of these four base colors are used to create various other colors. For instance, a green region of the image is produced by depositing a yellow layer of ink and a cyan layer of ink. Typically, multiple print heads are used to deposit each color, and the print heads associated with each color are clustered together. Typically, the order of the layering of ink as the carriage moves in one direction is reversed as the carriage moves in the opposite direction.

SUMMARY

The aforementioned printing systems have been accepted in the industry, and have performed reasonably well for their intended purpose. However, in certain applications a particular color will appear with a different hue even though the same combination of two or more of the base colors (for example, black, yellow, cyan, and magenta) were used to create the color because the order of the layering of the base colors changes over various regions of the image. For example, a green region produced with a layer of yellow ink deposited over a layer of cyan colored ink may appear differently to an observer than a green region produced with the layer of cyan colored ink deposited over a layer of yellow colored ink. This difference occurs because the effective visual spectrum is slightly shifted in frequency when the order of deposition is reversed as will be explained in detail later.

The present invention, generally, implements a printing system which prints multi-colored images in a manner such that a particular color appears with substantially the same hue to an observer regardless of which direction the carriage traverses as the ink is deposited onto the substrate.

In certain embodiments, a printing apparatus for printing images on a substrate includes a first set of print heads $S_1$ having at least two print heads $P_{1,1}$, $P_{1,2}$ arranged to deposit a first ink $I_1$, and a second set of print heads $S_2$ having at least two print heads $P_{2,1}$, $P_{2,2}$ arranged to deposit a second ink $I_2$. A first print head $P_{1,1}$ of the first set $S_1$ and a first print head $P_{2,1}$ of the second set $S_2$ respectively deposit the first ink $I_1$ and the second ink $I_2$ in a first order of deposition $O_1$, and a second print head $P_{1,2}$ of the first set $I_1$ and a second print head $P_{2,2}$ of the second set $S_2$ respectively deposit the first ink $I_1$ and the second ink $I_2$ in a second order of deposition $O_2$ as the printing apparatus traverses across the substrate in one direction $D_1$. The order of deposition of the first ink $I_1$ and the second ink $I_2$ from the print heads is reversed as the printing apparatus traverses across the substrate in an opposite direction $D_2$.

The printing apparatus may include one or more additional sets of print heads. Each of these additional print heads may have a first print head and a second print head that print in the same order as the first print heads of the first set and the second set of print heads, and the second print heads of the first set and the second set.

Each of the sets of print heads $S_1$, $S_2$ may a third print head $P_{1,3}$, $P_{2,3}$ and a fourth print head $P_{1,4}$, $P_{2,4}$, arranged to deposit respective inks $I_1$, $I_2$. The third print heads $P_{1,3}$, $P_{2,3}$ print in the same order as the first print heads $P_{1,1}$, $P_{2,1}$, and the fourth print heads $P_{1,4}$, $P_{2,4}$ print in the same order as the second print heads $P_{1,2}$, $P_{2,2}$.

In certain embodiments, the one or more additional sets of print heads may include at least a third set of print heads $S_3$ and a fourth set $S_4$ of print heads. The first print head of each set is positioned adjacent the to third print head of the respective set, and the second print head of each set is positioned adjacent to the fourth print head of the respective set.

In particular embodiments, the first set of print heads $S_1$ deposits black colored ink, the second set of print heads $S_2$ deposits cyan colored ink, the third set of print heads $S_3$ deposits magenta colored ink, and the fourth set of print heads $S_4$ deposits yellow colored ink.

The apparatus can include a controller coupled to the sets of print heads. The controller may provide instructions to the print heads to deposit ink in a particular order.

In some embodiments, a printing apparatus for printing images on a substrate includes a first set of print heads $S_1$ having at least one print head $P_{1,1}$ arranged to deposit a first ink $I_1$, and a second set of print heads $S_2$ having at least two print heads $P_{2,1}$, $P_{2,2}$ arranged to deposit a second ink $I_2$. The at least one print head $P_{1,1}$ of the first set $S_1$ and a first print head $P_{2,1}$ of the second set $S_2$ respectively depositing the first ink $I_1$ and the second ink $I_2$ in a first order of deposition $O_1$, and the at least one print head $P_{1,1}$ of the first set $I_1$ and a second print head $P_{2,2}$ of the second set $S_2$ respectively depositing the first ink $I_1$ and the second ink $I_2$ in a second order of deposition $O_2$ as the printing apparatus traverses across the substrate in one direction $D_1$. The order of deposition of the first ink $I_1$ and the second ink $I_2$ from the print heads is reversed as the printing apparatus traverses across the substrate in an opposite direction $D_2$.

In other embodiments, a method of printing on a substrate includes depositing a first color of ink from a first print head $P_{1,1}$ of a first set of "n" print heads $S_1$, and a second color of ink from a first print head $P_{2,1}$ of a second set of "n" print heads $S_2$ in a first order, and depositing the first color of ink from a second print head $P_{1,2}$ of the first set of "n" print heads $S_1$, and the second color of ink from a second print head $P_{2,2}$ of the second set of "n" print heads $S_2$ in a reverse order from the first order, where "n" is a number greater than one.

The method can include depositing the first color of ink from a third print head $P_{1,3}$ of the first set of "n" print heads $S_1$ and the second color of ink from a third print head $P_{2,3}$ of the second set of "n" print heads $S_2$ in the first order, and depositing the first color of ink from a fourth print head $P_{1,4}$ of the first set of "n" print heads $S_1$ and the second ink from a fourth print head $P_{2,4}$ of the second set of "n" print heads $S_2$ in the reverse order.

In certain embodiments, the order of printing is continuous as the printing apparatus traverses across the substrate. And in other embodiments, the order of printing is intermittently reversed such that the deposition of the ink is interlaced as the printing apparatus traversed across the substrate.

Among other advantages, the printing system of the present invention produces color images in which particular colors in different regions of the image appear substantially the same to an observer because of the way the pixels are interlaced or interweaved. That is, even though pixels of a particular color are created by depositing base colored inks in a different order, the present invention minimizes change in hue that occurs because the effective visual spectrum is slightly shifted in frequency when the order of deposition is reversed.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows.

Figure 1:
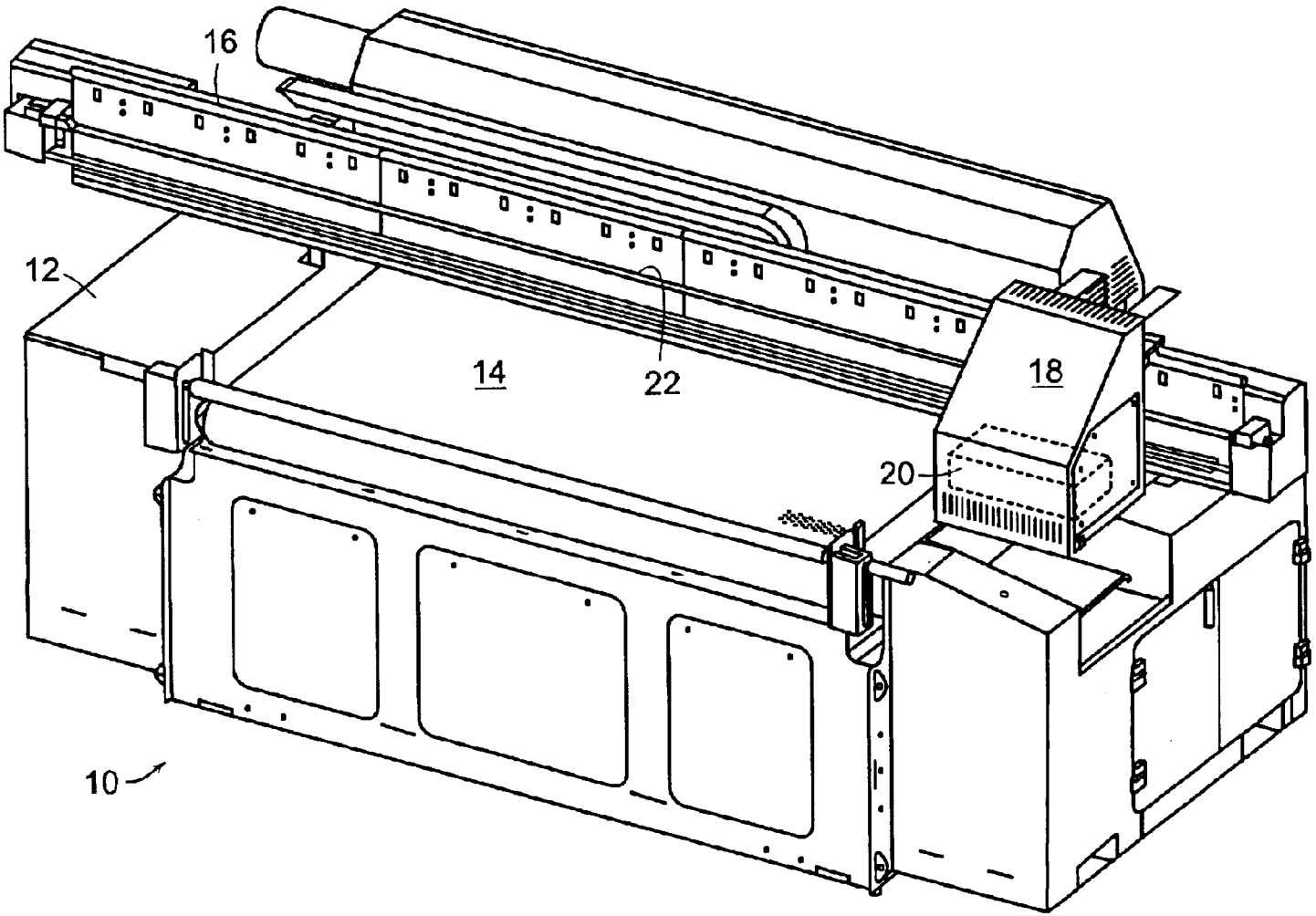
FIG. 1 is an perspective view of a printing system in accordance with the invention.

Turning now to the drawings, there is shown in FIG. 1 a printing system 10 provided with a carriage 18. The carriage 18 holds a series of ink jet print heads 20 configured for printing images on a variety of substrates. Typical substrates are polyvinyl chloride (PVC) and reinforced vinyl. The printing system 10 is able to print on flexible as well as on non-flexible substrates, such as, for example, metals, glass, and plastics. The inks deposited on the substrate can be solvent-based inks, or UV curable ink used, for example, in printing systems described in U.S. Pat. No. 6,457,823 and U.S. application Ser. No. 10/172,761, filed Jun. 13, 2002, incorporated herein by reference in their entireties.

Figure 2:
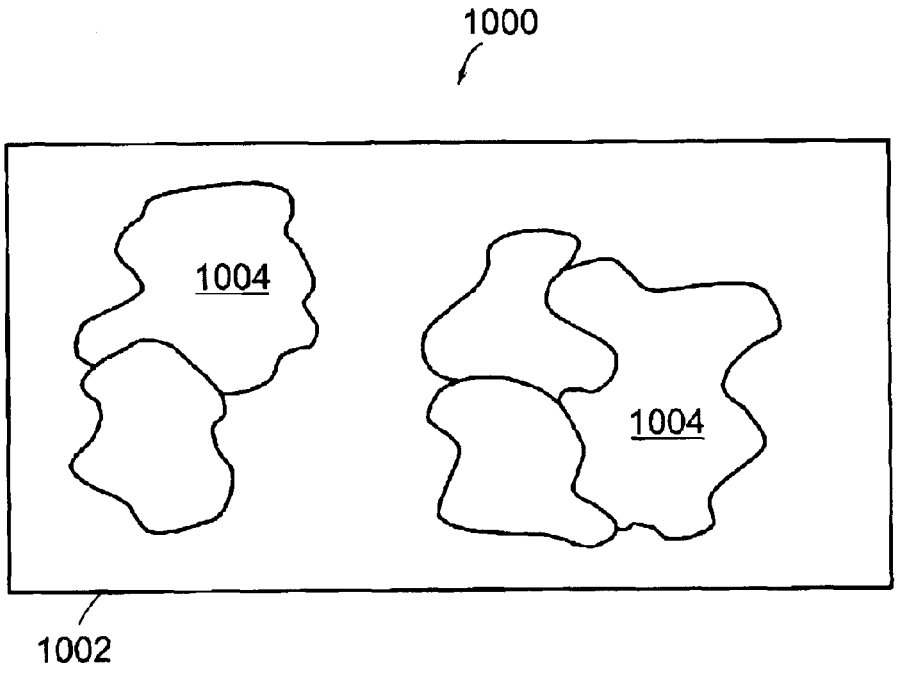
FIG. 2 is schematic illustration of an image created with the printing system of FIG. 1.
Figure 3A:
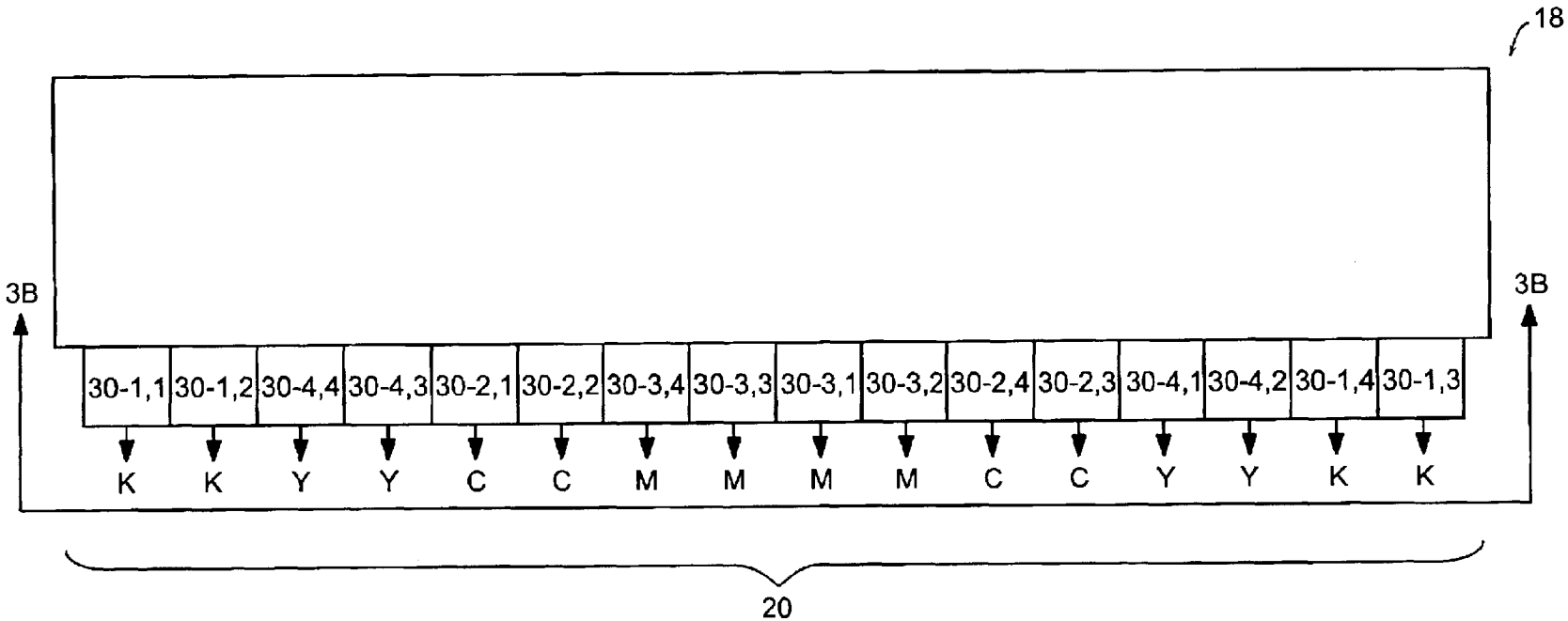
FIG. 3A is a side view of a carriage of the printing system of FIG. 1 holding a series of print heads.
Figure 3B:
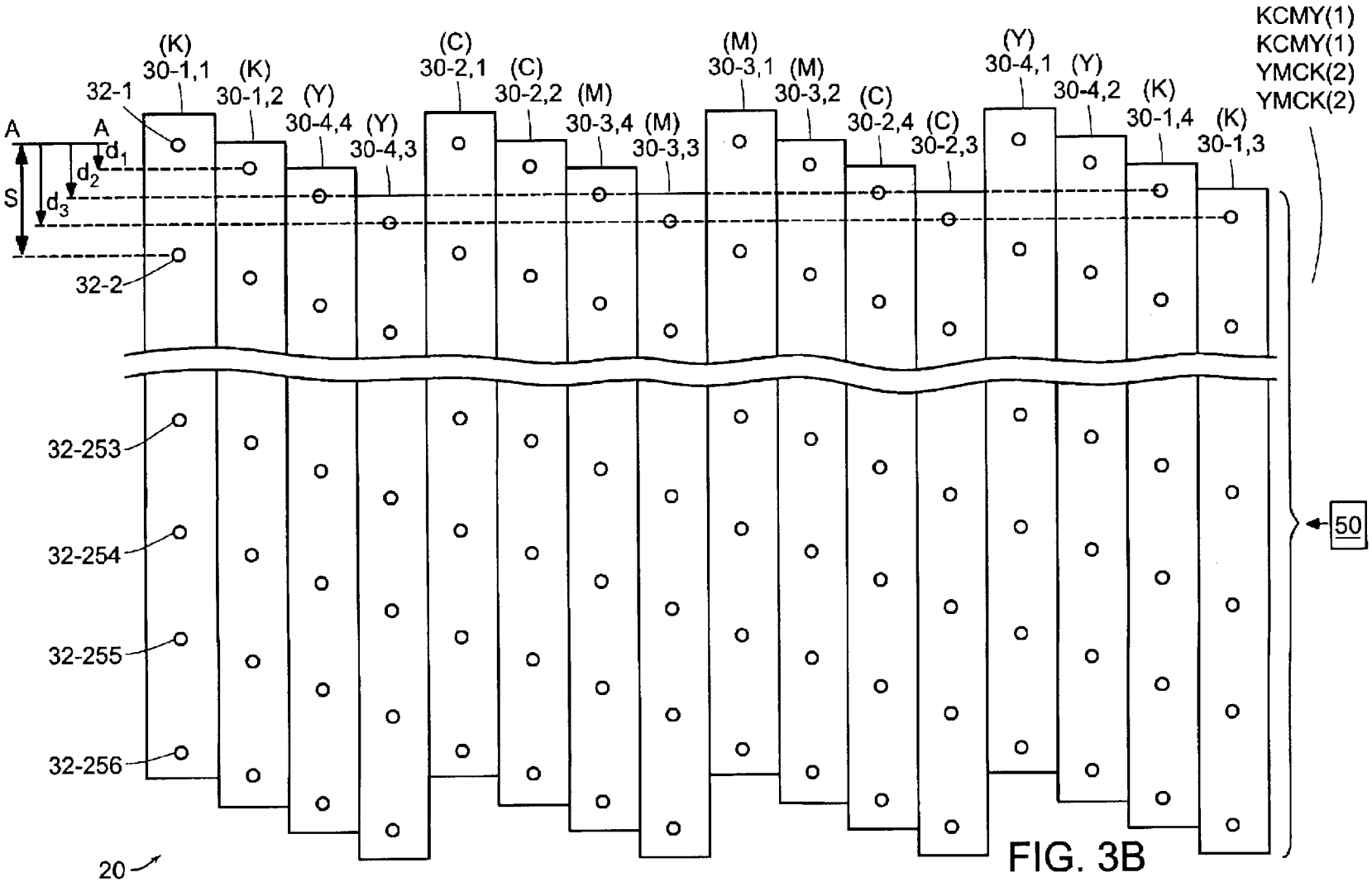
FIG. 3B is a bottom view of the carriage taken along the line 3B—3B of FIG. 3A illustrating a series of print heads in accordance with the invention.

In use, the printing system 10 prints multi-colored images using the base colored inks black (K), yellow (Y), cyan (C), and magenta (M) with the series of print heads 20 shown in FIGS. 3A and 3B. Various colors of a particular image are created by combining the base colors to create a desired image 1000 on a substrate 1002 (FIG. 2). For example, the color green over different regions 1004 of the image is created by combining yellow and cyan. The color green, as with other colors, appear the same to an observer regardless which direction the carriage 18 moved across to create the image.

In addition to the carriage 18, the printing system 10 includes a base 12, a transport belt 14 which moves the substrate 1002 through the printing system 10, and a rail system 16 attached to the base 12. The carriage 18 is attached to a belt 22 which is wrapped around a pair of pulleys positioned on either end of the rail system 16. A carriage motor is coupled to one of the pulleys and rotates the pulley during the printing process. Accordingly, as the transport belt 14 intermittently moves the substrate 1002 underneath the carriage 18, the pulleys transform the rotary motion of the motor to a linear motion of the belt 22 thereby causing the carriage 18 to traverse back and forth along the rail system 16 across the substrate as the series of ink jets 20 deposit ink onto the substrate.

The arrangement of the series of print heads 20 as they are mounted in the carriage 18 is illustrated in greater detail in FIGS. 3A and 3B. The series of print heads 20 includes four sets of print heads 30-*i,j*, where i=1, 2, 3, or 4 represents a particular set of print heads, and j=1, 2, 3, or 4 identifies an individual print head of each set. The first set of print heads 30-1,*j*, the second set of print heads 30-2,*j*, the third set of print heads 30-3,*j*, and the fourth set of print heads 30-4,*j* deposit black ink (K), cyan ink (C), magenta ink (M), and yellow ink (Y), respectively. Alternatively, the series of print heads 20 can include additional sets of print heads for depositing more that four colors. Such systems are described in detail in the aforementioned U.S. application Ser. No. 10/172,761, filed Jun. 13, 2002, incorporated herein by reference in its entirety.

As shown in FIG. 3B, each individual print head 30-*i,j* is provided with a multiplicity of nozzles 32. In particular, each print head has 256 nozzles labeled 32-1 through 32-256. Thus 1024 nozzles are employed to deposit each of the inks K, Y, C, and M.

For each print head 30-*i,j*, the spacing "s" between adjacent nozzles 32 about 4/360 inch. Thus, for a printing system with a resolution of 360 dots per inch (dpi), the nozzles for each print head of each of the four sets are offset from each other by a distance of 1/360 inch. For instance, if the reference line A—A identifies the position of the nozzle 32-1 of the (K) print head 30-1,1, then the nozzles 30-1 of the print heads 30-1,2, 30-1,4, and 30-1,3 are offset by the distance "d1" of 1/360 inch, "d2" of 2/360 inch, and "d3" of 3/360 inch, respectively, from the reference line A—A. The other nozzles 32-2 through 32-256 are similarly offset for the (K) set of print heads 30-3,*i*. The print heads of the other three sets 30-2,*j*, 30-3,*j*, and 30-4,*j* are arranged so that the nozzles 30 of these print heads are similarly offset. In operation, the print heads receive commands from a controller 50 which determines the order of deposition of the base inks.

Figure 4:
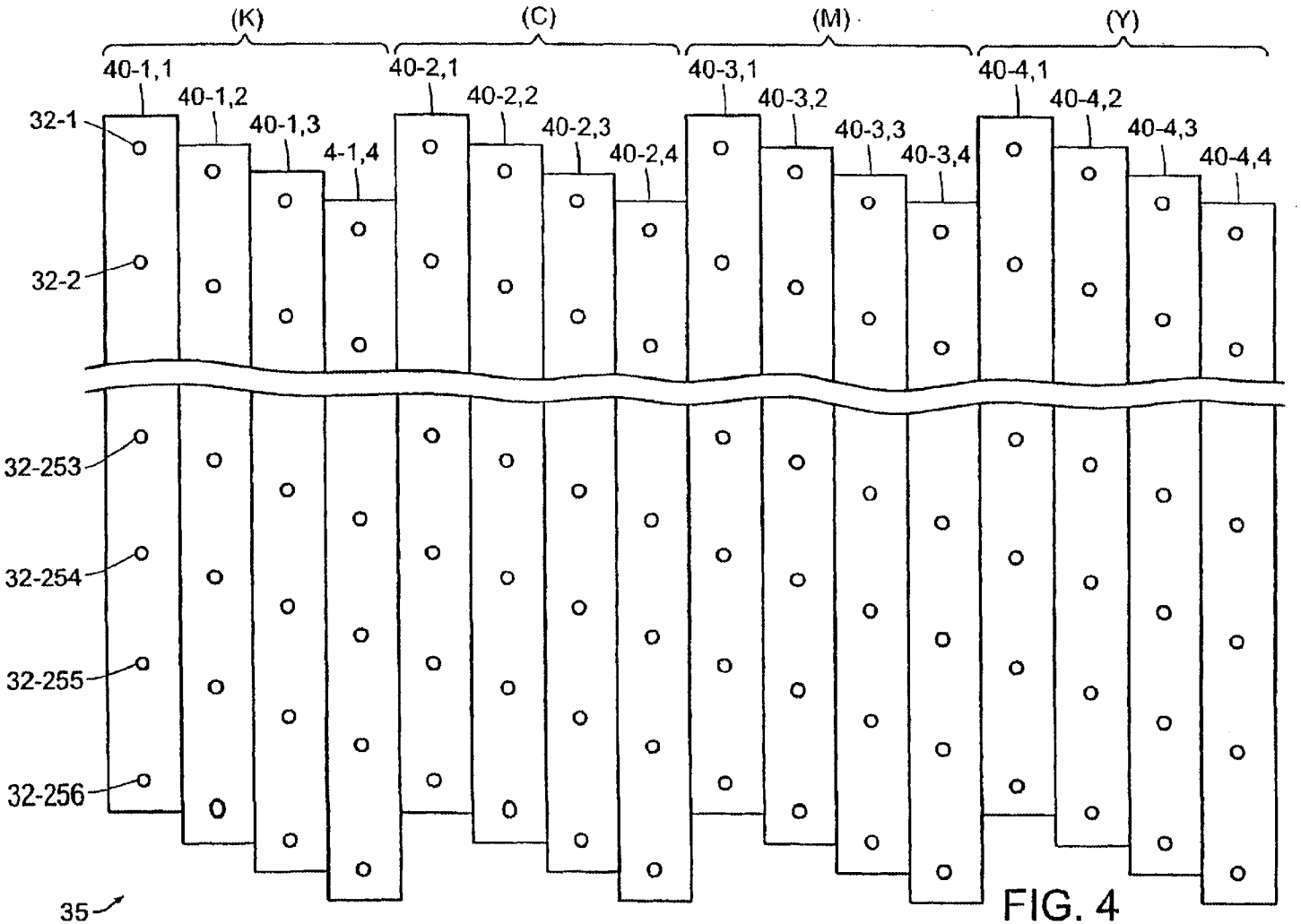
FIG. 4 (PRIOR ART)
FIG. 4 is a bottom view of a prior art configuration of a series of print heads.

For illustrative purposes, the arrangement of the print heads shown in FIGS. 3A and 3B is contrasted with the arrangement of the print heads used in certain prior art printing systems, such as shown in FIG. 4. In the configuration of FIG. 4, a series of print heads 35 includes four sets of print heads 40-*i,j*, where i=1, 2, 3, or 4 represents a particular set of print heads, and j=1, 2, 3, or 4 indicates an individual print head for each set. The series of print heads 35 also deposits the four inks K, Y, C, and M. Thus, the first set of print heads 40-1,*j*, the second set of print heads 40-2,*j*, the third set of print heads 40-3,*j*, and the fourth set of print heads 40-3,*j* deposit black ink (K), yellow ink (Y), cyan ink (C), and magenta ink (M), respectively. However, unlike the series of print heads 20 discussed above, note that each set of print heads 40-*i,j* of the series of print heads are clustered together.

Thus, as a carriage, similar to the carriage 18, holding the series of print heads 40 traverses across the substrate in one direction the series of print heads 40 will deposit ink in one order and then deposit the inks in a reverse order when the carriage 18 traverses across the substrate in the opposite direction. Therefore, to produce a red colored region of an image, the yellow colored ink will be deposited over the magenta ink (FIG. 5A) as the carriage moves in one direction, and then the magenta colored ink will be deposited on top of the yellow colored ink (FIG. 5B) as the carriage moves in the other direction.

Figure 5A:
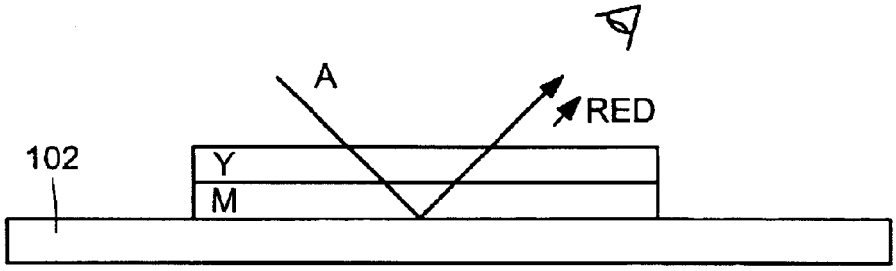
FIG. 5A is a depiction of the visualization of a layer of yellow colored ink deposited on top of a layer of magenta colored ink.
Figure 5B:
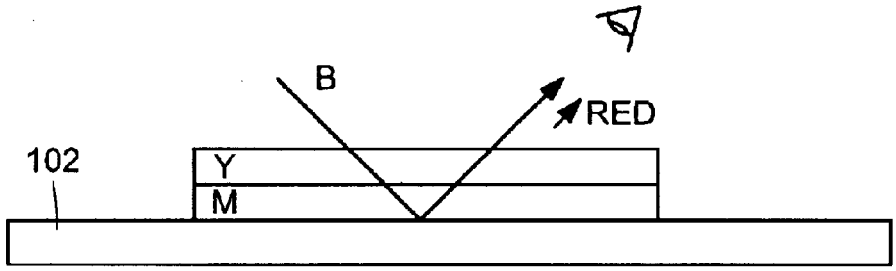
FIG. 5B is a depiction of the visualization of a layer of magenta colored ink deposited on top of a layer of yellow colored ink.
Figure 6:
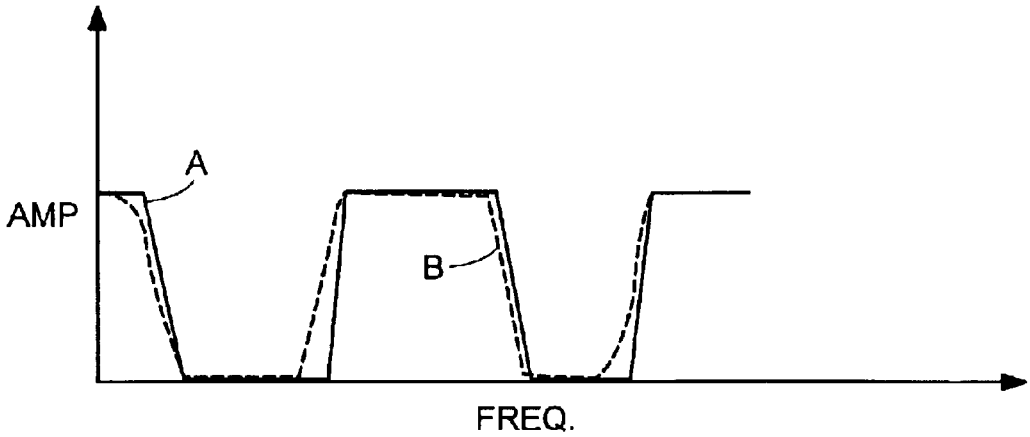
FIG. 6 illustrates the frequency spectrum for the layers of ink of FIGS. 5A and 5B.

However, by reversing the order of deposition of the magenta and yellow inks, the red region of FIG. 5A will appear slightly different to an observer than that shown in FIG. 5B. This difference is illustrated with reference to FIG. 6 which illustrates the frequency spectrum of the "red" produced by the different ordering of the magenta and yellow inks. As can be seen, the spectrum (solid line labeled A) of the red produced with yellow on top of magenta (FIG. 5A) is slightly shifted from that of the spectrum (dashed line labeled B) of the red produced with the reverse order yellow and magenta (FIG. 5B). Accordingly, this slight shift or offset of the two spectrums results in the red of FIG. 5A to appear with a different hue or intensity than the red of FIG. 5B.

Figure 7:
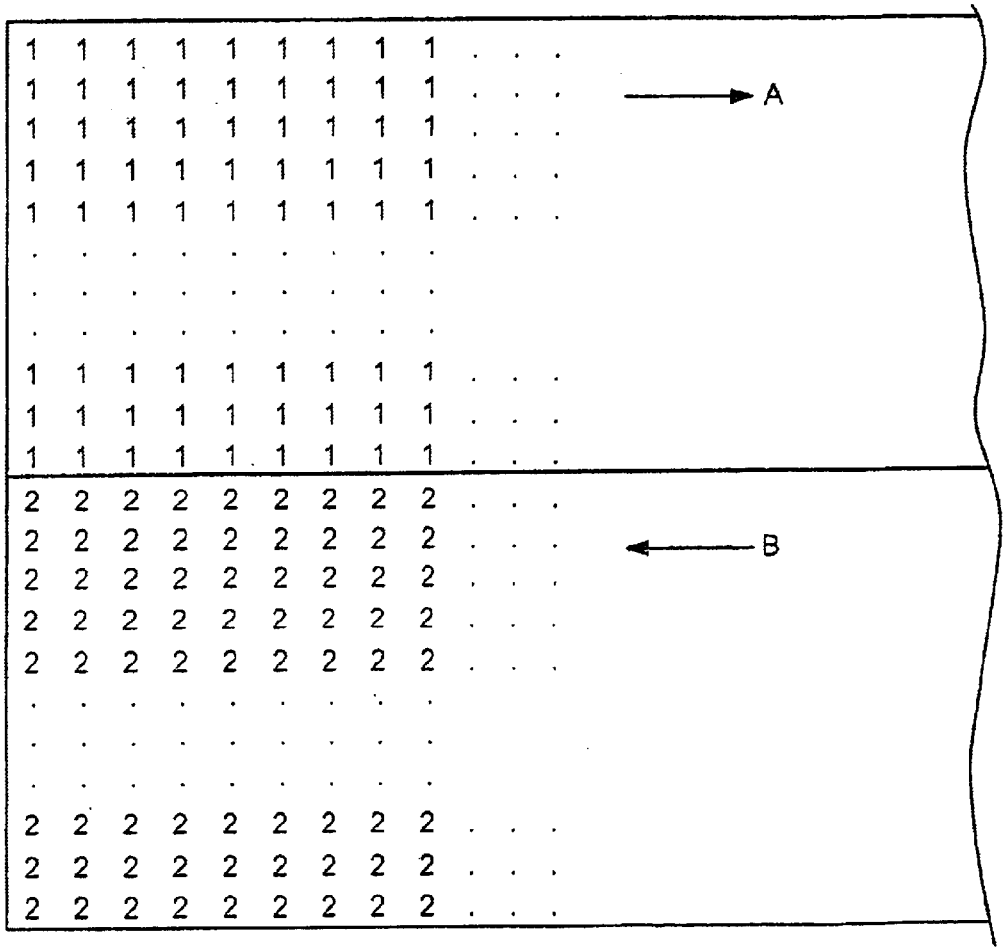
FIG. 7 (PRIOR ART)
FIG. 7 illustrates the print order using the prior art configuration of print heads of FIG. 4.

Referring now to FIG. 7, there is depicted the order of layering of the base colors with the prior art series of print heads 35 for two passes across the substrate 32. The upper track a represents the pass of the carriage 18 as it moves from left to right, while the lower track b represents the pass as the carriage 18 moves from right to left. The numeral 1 identifies a potential pixel of the image created with one or more base colors in the order KCYM, for example, the color green is produced by first depositing C and then Y at a particular pixel. On the other hand, the numeral 2 identifies a potential pixel created in the reverse order MYCK. Thus in the second order, a pixel of the color green is created by first depositing Y and then C. Accordingly, pixels of the image created in the upper track a are produced with the base inks layered in the first order, and that created in the lower track b are produced with the base inks layered in the second order.

Figure 8:
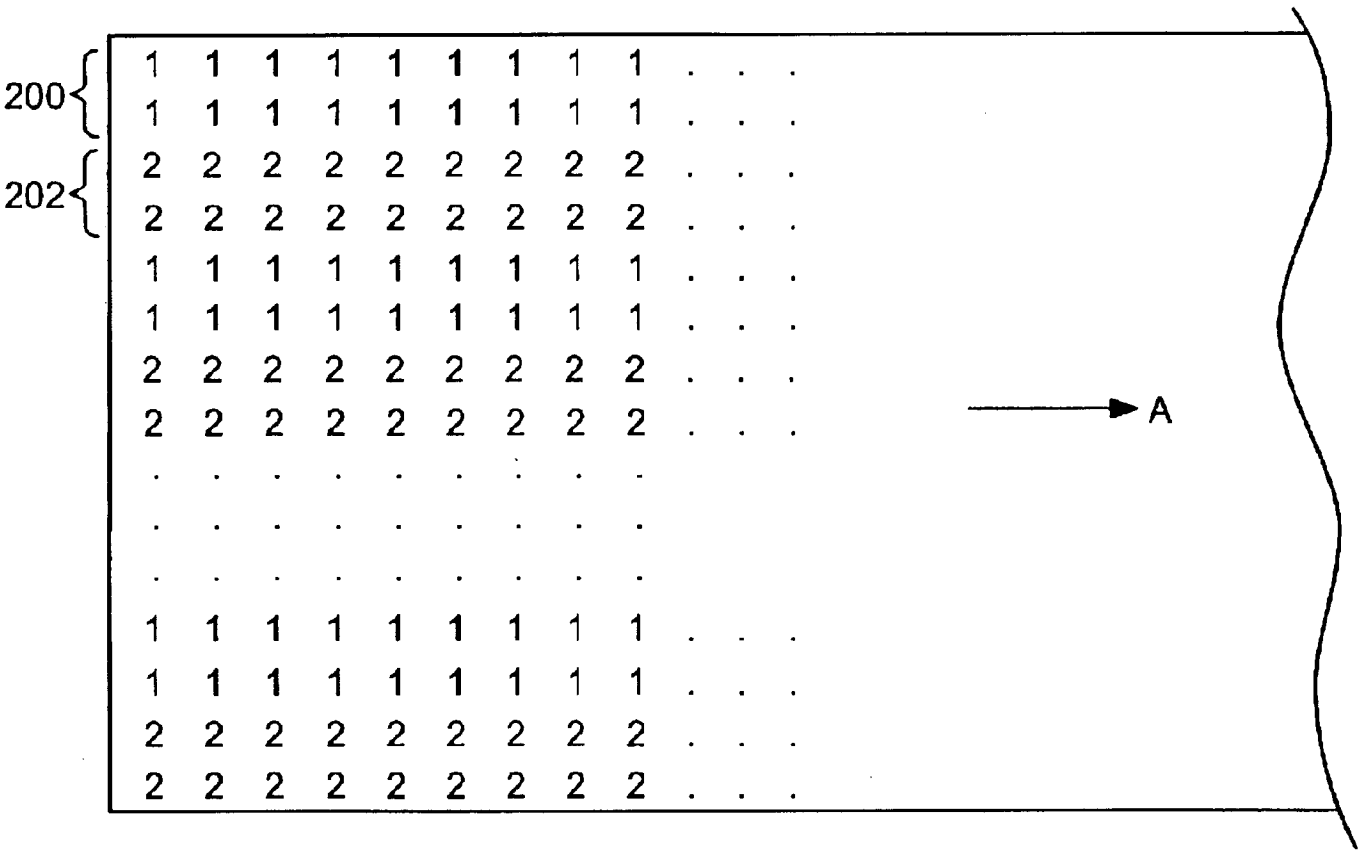
FIG. 8 illustrates the print order using the of print heads of FIGS. 3A and 3B.

By way of contrast, as shown in FIG. 8, the series of print heads 20 shown in FIGS. 3A and 3B is able to deposit the base inks in both the first and the second orders as the carriage 18 moves in one direction in a single pass a. For instance, the first two rows 200 are made of pixels created with the first order and the next two rows 202 are made with the second order so that the order changes every two rows. As the carriage 18 moves in the opposite direction from right to left, the ordering would be merely switched. That is, the number 1 would be simply exchanged with 2 and 2 with 1.

In the illustrated embodiment, as the carriage moves in the single pass a the order 2 is accomplished with the print heads 30-1,1 and 30-1,2 for the black ink, the print heads 30-2,1 and 30-2,2 for the cyan ink, the print heads 30-3,1 and 30-3,2 for magenta ink, and the print heads 30-4,1 and 30-4,2 for the yellow ink, while the order 1 is accomplished with the print heads 30-4,3 and 30-4,4 for the yellow ink, the print heads 30-3,3 and 30-3,4 for the magenta ink, the print heads 30-2,3 and 30-2,4 for cyan ink, and the print heads 30-1,3 and 30-1,4 for the black ink. Note that all the print heads can be set to print in one order for each pass. Accordingly, the printing system 10 is also capable of printing images with the ordering shown in FIG. 7, if desired.

Figure 9:
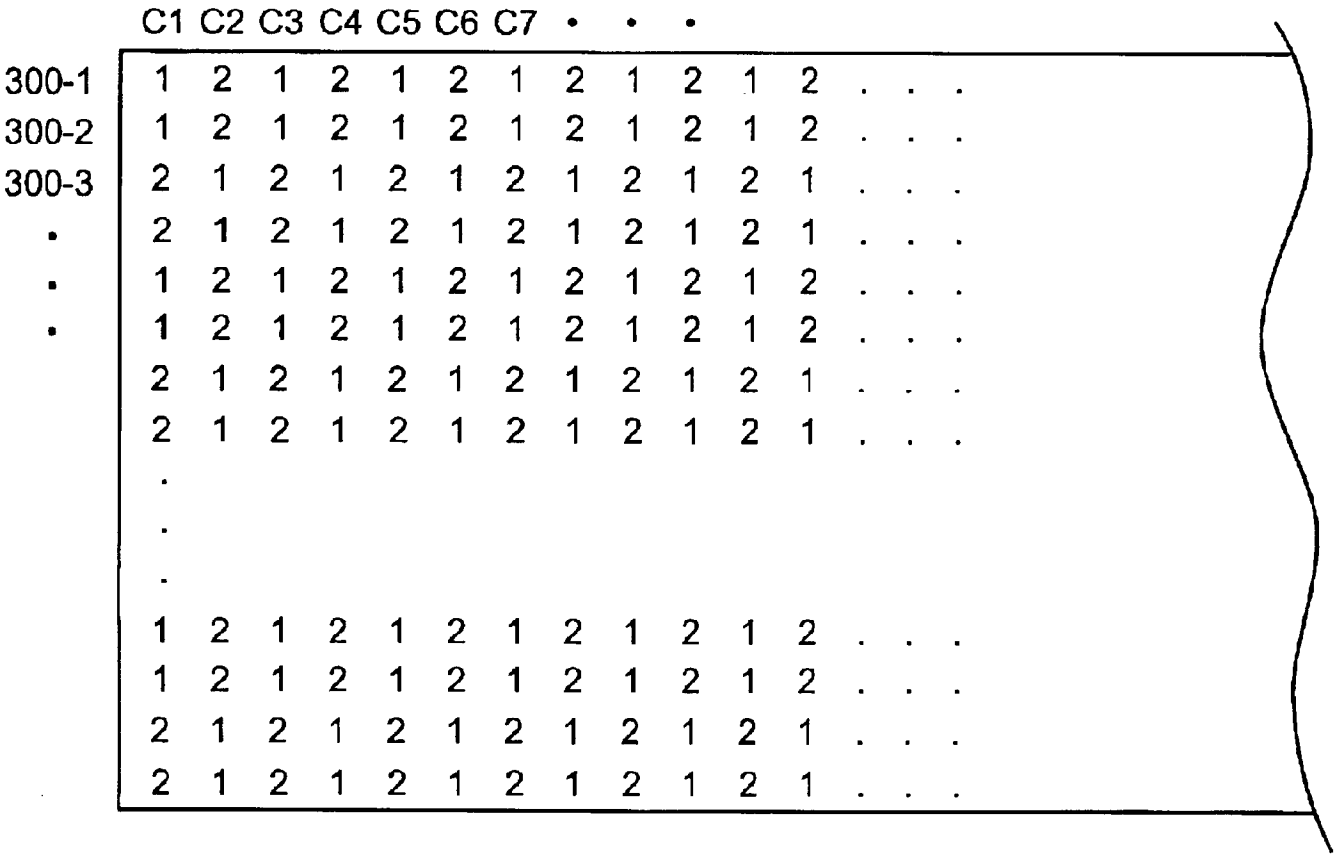
FIG. 9 illustrates the interlaced print order using the configuration of print heads of FIGS. 3A and 3B.

Under the direction of the controller 50, the series print heads 20 can print with an even greater level of interlacing by switching the order of layering for adjacent pixels. For instance, as shown in FIG. 9, along each row 300-*k*, the order of layering switches between adjacent pixels. Thus as instructed by the controller 50, the print heads 30-*i,j* would deposit ink for every other column, that is, column C1, C3, C4, and so on, as the carriage 18 and hence the print heads move towards the right. Then, the print heads would move in the opposite direction from left to right while the print heads 30-*i,j* deposit ink along the previously skipped columns (C2, C4, C6 and so on).

Thus, in FIGS. 8 and 9 the reverse orders of layering are more finely interlaced or interweaved than that shown for the prior art configuration of FIG. 7. Visually, to an observer, a particular color of the image created with the ordering shown in FIGS. 8 and 9 will appear more similar over the image than that created with the ordering of FIG. 7. Note that as the layering is more finely interlaced, the speed at which the images are created is likely reduced. Thus, the printing system 10 is able to produce images at multi-speeds depending on the quality of the image desired. Hence, the printing system 10 can produce images with low resolution at high speeds such as those referred to in FIG. 7, and images with higher resolution by interlacing the ordering of the layers such as those shown in FIGS. 8 and 9.

Figure 10:
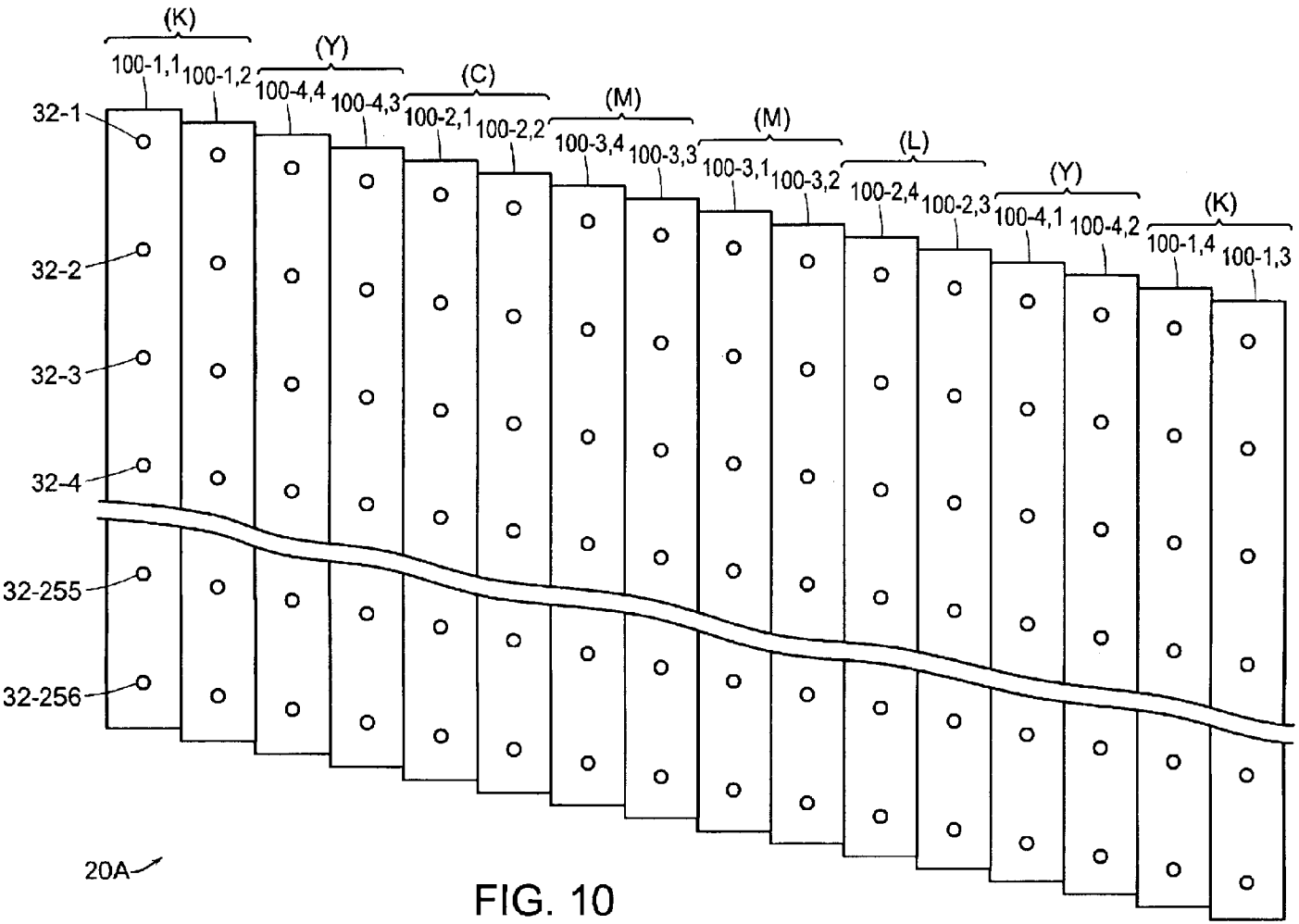
FIG. 10 is a bottom view of an alternative embodiment of a series of print heads in accordance with the invention.

Although the print heads 30-*i,j* shown in FIG. 3B are arranged in a staggered fashion, they need not be arranged in such a manner. For example, there is shown in FIG. 10 an alternative arrangement of the series of print heads 20*a* provided with individual print heads 100-*i,j*, where i,j are the same indices as described above. While comparing the configuration of FIG. 10 with that of FIG. 3B, it can be seen that the print heads 100-*i,j* are not staggered as those of 30-*i,j*. However, the function of the print heads 100-*i,j* are identical to that of print heads 30-*i,j*, that is, the print heads 100-*i,j* will produce images identical to those referred to in FIGS. 8 and 9.

Figure 11:
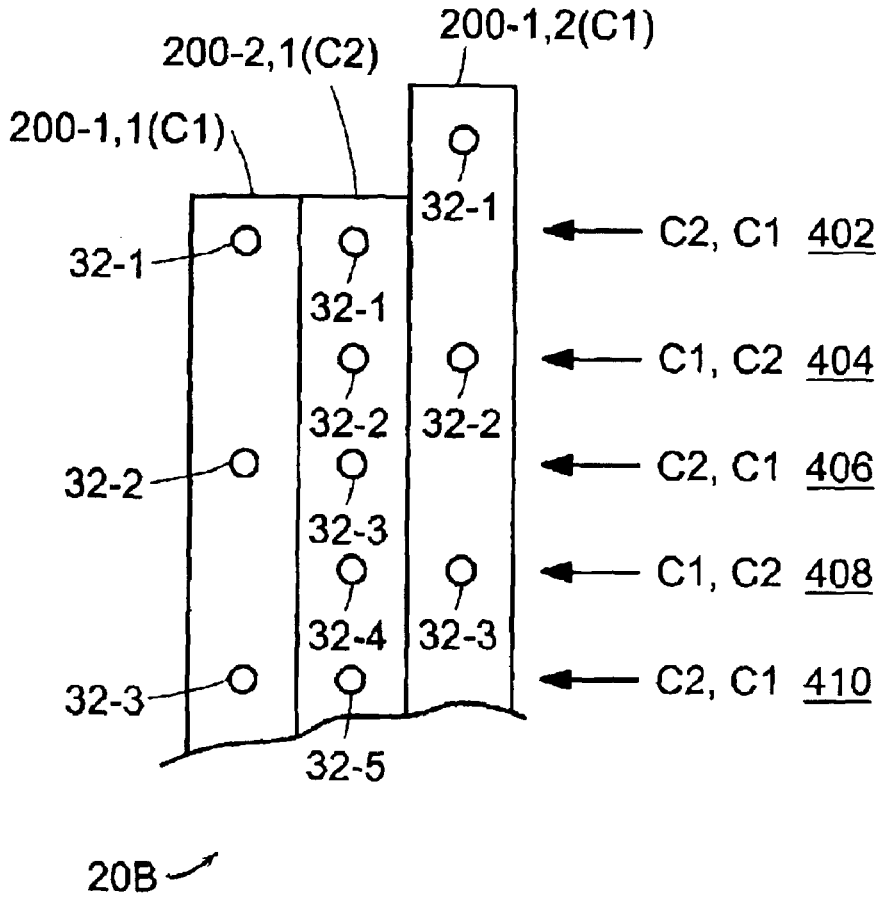
FIG. 11 is a bottom view of yet another alternative embodiment of a series of print heads in accordance with the invention.

In other implementations, one or more print heads may be provided with more than 256 nozzles, or may be provided with more nozzles than some or all of the other print heads. For instance, there is shown in FIG. 11, a series of print heads 20*b* with a printhead 200-2,1 which deposits a colored ink C2, positioned between, and that has twice the number of nozzles 32 as, a pair of print heads 200-1,1 and 200-1,2 which deposit a different colored ink C1. Accordingly, during a printing operation, as the print heads deposit ink in the sequence 200-1,2, 200-2,1, and 200-1,1, the pixels along the rows 402, 406, 410, . . . , are formed with inks deposited in the order C2, C1, while the pixels along the rows 404, 406, . . . , are formed with inks deposited in the order C1, C2. As before, the orders are reversed as the print heads traverse in the opposite direction. Although FIG. 11 illustrates creating an image with two colored inks, the arrangement of FIG. 11 can be extended to three, four, or more colored inks.

While this invention has been particularly shown and described with references to preferred embodiments thereof, it will be understood by those skilled in the art that various changes in form and details may be made therein without departing from the scope of the invention encompassed by the appended claims.

What is claimed is:

1. A printing apparatus for printing images on a substrate, comprising:

a first set of print heads $S_1$ having at least two print heads $P_{1,1}$, $P_{1,2}$ arranged to deposit a first ink $I_1$; and a second set of print heads $S_2$ having at least two print heads $P_{2,1}$, $P_{2,2}$ arranged to deposit a second ink $I_2$, a first print head $P_{1,1}$ of the first set $S_1$ and a first print head $P_{2,1}$ of the second set $S_2$ respectively depositing the first ink $I_1$ and the second ink $I_2$ in a first order of deposition $O_1$, and a second print head $P_{1,2}$ of the first set $I_1$ and a second print head $P_{2,2}$ of the second set $S_2$ respectively depositing the first ink $I_1$ and the second ink $I_2$ in a second order of deposition $O_2$ as the printing apparatus traverses across the substrate in one direction $D_1$, the order of deposition of the first ink $I_1$ and the second ink $I_2$ from the print heads being reversed as the printing apparatus traverses across the substrate in an opposite direction $D_2$.

2. The printing apparatus of claim 1, further comprising one or more additional sets of print heads, each of the one or more sets of print heads having a first print head and a second print head, the first print heads of the additional sets printing in the same order as the first print heads of the first and second sets, and the second print heads of the additional sets printing in the same order as the second print heads of the first and second sets.

3. The printing apparatus of claim 1, wherein each of the at least two sets of print heads $S_1$, $S_2$ includes a third print head $P_{1,3}$ $P_{2,3}$ and a fourth print head $P_{1,4}$, $P_{2,4}$, arranged to deposit respective inks $I_1$, $I_2$, the third print heads $P_{1,3}$, $P_{2,3}$ printing in the same order as the first print heads $P_{1,1}$, $P_{2,1}$, and the fourth print heads $P_{1,4}$, $P_{2,4}$ printing in the same order as the second print heads $P_{1,2}$ $P_{2,2}$.

4. The printing apparatus of claim 3, further comprising one or more additional sets of print heads, each including a first print head, a second print head, a third print head, and a fourth print head, the first and third print heads of the additional sets printing in the same order as the first and third print heads of the first and second sets, and the second and fourth print heads of the additional sets printing in the same order as the second and fourth print heads of the first and second sets.

5. The printing apparatus of claim 4, wherein the one or more sets of print heads is a third set of print heads and a fourth set of print heads.

6. The printing apparatus of claim 5, wherein the first print head of each set is positioned adjacent to the third print head of the respective set, and the second print head of each set is positioned adjacent to the fourth print head of the respective set.

7. The printing apparatus of claim 6, wherein the fourth set is positioned between third print head and the second print head of the first set, the second set is positioned between the fourth print head of the fourth set and the first print head of the fourth set, the third set is positioned between the third print head of the second set and the second print head of the second set.

8. The printing apparatus of claim 7, wherein the second print head and the third print head of the fourth set are positioned adjacent to the third print head and the second print head of the first set, respectively, the first print head and the fourth print head of the second set are positioned adjacent to the fourth print head and the first print head of the fourth set, respectively, and the second print head and the third print head of the third set positioned adjacent to the third print head and the second print head of the second set, respectively, so that the fourth print head of the third set is positioned adjacent to the first print head of the third set.

9. The printing apparatus of claim 5, wherein the first set of print heads deposits black colored ink, the second set of print heads deposits cyan colored ink, the third set of print heads deposits magenta colored ink, and the fourth set of print heads deposits yellow colored ink.

10. The printing apparatus of claim 1, further comprising a controller coupled to the at least two sets of print heads, the controller providing instructions to the print heads as to the order of deposition of the inks.

11. A method of printing on a substrate, comprising:

depositing a first color of ink from a first print head $P_{1,1}$ of a first set of "n" print heads $S_1$ and a second color of ink from a first print head $P_{2,1}$ of a second set of "n" print heads $S_2$ in a first order; and depositing the first color of ink from a second print head $P_{1,2}$ of the first set of "n" print heads $S_1$ and the second color of ink from a second print head $P_{2,2}$ of the second set of "n" print heads $S_2$ in a reverse order from the first order, wherein "n" is a number greater than one, the print heads depositing the first color ink and the second color ink in both the first order and the reverse order as the print heads traverse across the substrate in one direction $D_1$.

12. The method of claim 11, further comprising depositing the first color of ink from a third print head $P_{1,3}$ of the first set of "n" print heads $S_1$ and the second color of ink from a third print head $P_{2,3}$ of the second set of "n" print heads $S_2$ in the first order, and depositing the first color of ink from a fourth print head $P_{1,4}$ of the first set of "n" print heads $S_1$ and the second ink from a fourth print head $P_{2,4}$ of the second set of "n" print heads $S_2$ in the reverse order.

13. The method of claim 11, wherein the order of printing is continuous as the printing apparatus traverses across the substrate.

14. The method of claim 11, wherein the order of printing is intermittently reversed such that the deposition of the ink is interlaced as the printing apparatus traverses across the substrate.

15. A printing apparatus for printing images on a substrate, comprising:

a first set of print heads $S_1$ having at least one print head $P_{1,1}$ arranged to deposit a first ink $I_1$; and a second set of print heads $S_2$ having at least two print heads $P_{2,1}$ $P_{2,2}$ arranged to deposit a second ink $I_2$, the at least one print head $P_{1,1}$ of the first set $S_1$ and a first print head $P_{2,1}$ of the second set $S_2$ respectively depositing the first ink $I_1$ and the second ink $I_2$ in a first order of deposition $O_1$, and the at least one print head $P_{1,1}$ of the first set $I_1$ and a second print head $P_{2,2}$ of the second set $S_2$ respectively depositing the first ink $I_1$ and the second ink $I_2$ in a second order of deposition $O_2$ as the printing apparatus traverses across the substrate in one direction $D_1$, the order of deposition of the first ink $I_1$ and the second ink $I_2$ from the print heads being reversed as the printing apparatus traverses across the substrate in an opposite direction $D_2$.

* * * * *